United States Patent [19]

Acker

[11] Patent Number: 4,601,311

[45] Date of Patent: Jul. 22, 1986

[54] SUB-SEA PILOT-OPERATED VALVE

[75] Inventor: Richard C. Acker, Chagrin Falls, Ohio

[73] Assignee: Teledyne Industries, Inc., Los Angeles, Calif.

[21] Appl. No.: 687,518

[22] Filed: Dec. 28, 1984

[51] Int. Cl.[4] ..... F15B 13/042

[52] U.S. Cl. ..... 137/625.66; 137/625.25

[58] Field of Search ..... 137/625.25, 625.66, 137/625.68; 251/174, 282

[56] References Cited

U.S. PATENT DOCUMENTS

| | | | |
|---|---|---|---|
| 2,394,487 | 2/1946 | Rotter et al. | 137/625.68 X |
| 2,699,417 | 2/1954 | Ray | 251/174 X |
| 2,732,860 | 1/1956 | Ray | 251/282 X |
| 3,215,163 | 11/1965 | Henderson | 137/625.66 X |
| 3,324,888 | 6/1967 | Henderson | 137/625.68 |
| 3,457,957 | 7/1969 | Mueller | 137/625.25 X |
| 3,776,276 | 12/1973 | Stiltner | 251/174 X |
| 4,187,884 | 2/1980 | Loveless | 137/625.66 X |
| 4,220,074 | 9/1980 | Reip | 251/174 X |
| 4,340,203 | 7/1982 | Donner | 137/625.68 X |
| 4,513,783 | 4/1985 | Inoue | 137/625.63 X |

FOREIGN PATENT DOCUMENTS

| | | | |
|---|---|---|---|
| 2102540 | 2/1983 | United Kingdom | 137/625.66 |

*Primary Examiner*—Gerald A. Michalsky

*Attorney, Agent, or Firm*—Pearne, Gordon, Sessions, McCoy, Granger & Tilberry

[57] ABSTRACT

A pilot-operated, directional control valve having a ported slide and cooperating, non-interflow, shear-type seals. The valve achieves a high flow capacity for a given size by utilizing both of a pair of opposed sleeve seals to conduct flow through the valve. The valve response is improved by a hydraulic bias of supply pressure on the slide which requires operation at a high pilot pressure.

6 Claims, 4 Drawing Figures

SUB-SEA PILOT-OPERATED VALVE

BACKGROUND OF THE INVENTION

The invention relates to directional control valves, and particularly to such valves that are pilot-operated and incorporate fail-safe features.

Characteristically, shear seal type valves afford the advantage of low operating force. Typically, non-interflow shear seal valve arrangements are limited in flow capacity because the internal valving flow paths are held to limited dimensions so that the host valving elements are not overly large and the valve housing body is of a practical cost-effective size. Restricted flow capacity in a valve can adversely affect response time of the control circuit in which it is employed.

Other factors which can seriously delay response of a pilot-operated valve are long pilot control lines and compressibility of the fluid in the line. Blow-off preventer systems in underwater oil and gas wells are one application where a relatively long pilot control line may be required. By way of example, a pilot control line of a length of 27,000 feet, for example, and using a water-based control fluid, may exhibit a delay of 1½ minutes in a pressure signal change from 220 psi to 600 psi.

SUMMARY OF THE INVENTION

The invention provides a directional control valve of the shear seal type which is non-interflow and which affords a relatively high flow capacity. The valve includes a double-faced slide and pairs of opposed seals on each slide face. The opposed, paired seals are each arranged to contribute to fluid through the valve. Since the total flow through a local flow path area of the slide is the sum of that through each of a pair of opposed seals, a relatively small seal size corresponding to a small slide port size can be utilized while achieving a flow capacity equal to twice that of one operative seal.

The valve is operated by pilot line pressure which shifts it to an open position, and is biased by spring force and supply pressure to an opposite closed position. The valve utilizes supply line pressure bias to require a relatively high pilot line pressure for valve actuation.

The disclosed valve is particularly suited for use in blow-out preventer systems for underwater gas and oil wells where fast response time and fail-safe operation are critical. Relatively fast shifting response is achieved by the valve, since the pilot control line is caused to operate at a pressure level where much of the compressibility of the pilot fluid, e.g., water and soluble oil, is taken up. Supply fluid capacity at the valve, which is arranged to shift it upon a drop-in pilot line pressure, is conserved by the non-interflow seal structure which avoids loss of supply fluid to exhaust during valve shifting action. This feature is particularly important where the supply fluid source is from an accumulator or otherwise limited in volume or flow rate. The biasing spring force is arranged even in case of hydraulic failure of the supply source circuit to shift the valve slide to the closed position. In the closed position of the valve, the supply line is sealed off and the control or cylinder line is exhausted. The control circuit double flow paths in the slide allow control pressure to exhaust at high flow rates upon closing of the valve.

DESCRIPTION OF THE PREFERRED EMBODIMENT

Figure 1:
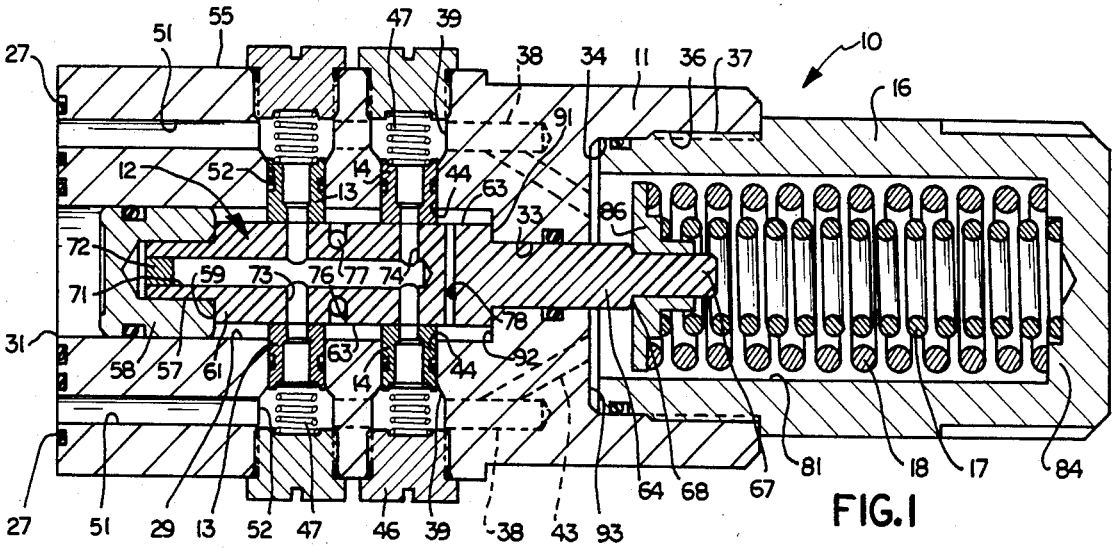
FIG. 1 is a longitudinal, cross-sectional view of a valve constructed in accordance with the invention.
Figure 2:
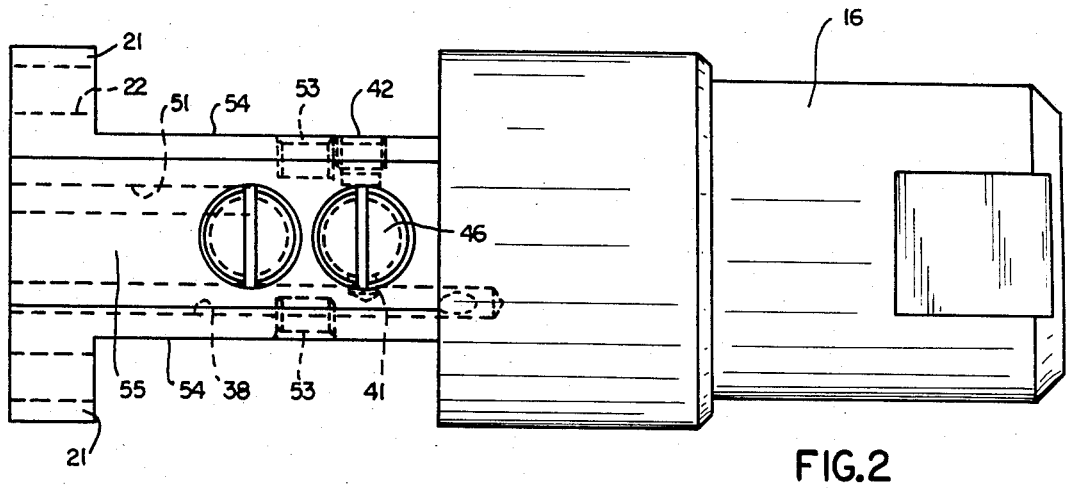
FIG. 2 is a plan view of the valve of FIG. 1.

Referring now to the drawing, there is illustrated a directional control valve 10 having a main body 11 in which is disposed a slide 12 and cooperating, generally cylindrical sleeve seals, 13, 14. An end cap 16 houses slide biasing springs 17, 18.

Figure 3:
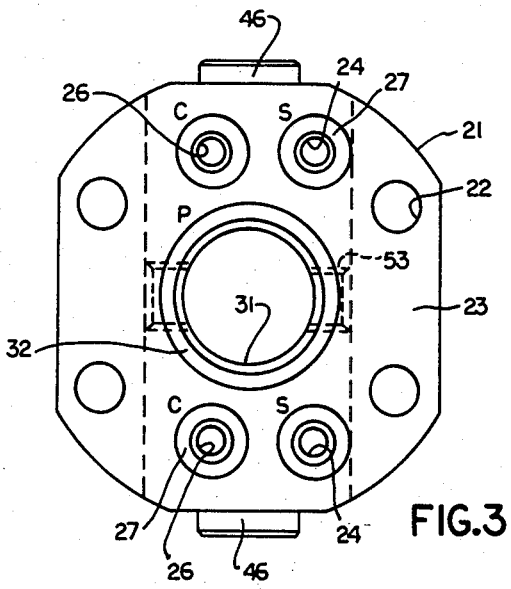
FIG. 3 is an end view of the valve of FIG. 1.

The housing main body 11 is fabricated of suitable material, such as steel, stainless steel or the like. In the illustrated case, the body 11 is an elongated member having flanges 21 at one end for surface mounting the body to a hydraulic manifold or other receiving structure. The flanges 21 have a set of bolt holes 22 extending parallel to the longitudinal axis of the body 11 for mounting purposes. An outer face 23 of the flanged end of the body 11 has a set of body ports 24, 26 for communication with similar ports on the receiving manifolds. As will be understood from the description below, the duplex ports 24 at the right in FIG. 3 are arranged to receive supply fluid under pressure, ordinarily from a common source. For this reason the letter "S" for "supply" appears near these ports. The duplex ports 26 at the left are similarly commonly connected with a control element or cylinder, and the letter "C" appears near them. O-rings 27 provide seals for the ports 24, 26 when the body 11 is bolted to the receiving manifold.

A central cylindrical bore or cavity 29 extends longitudinally along a major length of the body 11. The bore 29 is open at the flanged outer face 23 to form a port 31 for receiving pilot control pressure fluid from a complementary port on the receiving manifold to which it is sealed by an O-ring 32.

A reduced diameter bore 33 extends coaxially between the bore 29 and another larger bore 34 at an opposite end of the body 11. The latter bore 34 is internally threaded at 36 for receiving the mating threads 37 of the end cap 16. With reference to FIGS. 1 and 3, it will be seen that the internal circuitry and assembly of parts on the upper half of the body 11 is a mirror image of that of the lower half. Drilled duplex passages 38 parallel to the main bore 29 connect the supply ports 24 with stepped cylindrical cavities 39 through drilled cross holes 41. Outer ends of the drilled cross holes 41 are plugged at 42. In FIG. 1, the phantom lines designating the passages 38 are for reference purposes, and it is to be understood that the location of these passages 38 is above the plane of the drawing in this view. Diagonally drilled holes 43 connect these supply port passages 38 to the enlarged bore 34. The cylindrical cavities 39 are coaxial with one another and radial to the slide bore 29. Inner ends 44 of these opposed cavities receive the sleeve seals 13 with a sliding fit and are sealed therewith by O-rings. The outer end of each cavity 39 is internally threaded for receiving mating threads of a plug 46 which closes it off. Each plug 46 also retains a compression spring 47, which biases the associated sleeve seal 13 against the slide 12.

Drilled duplex passages 51 parallel to the slide bore 29 connect the control ports 26 with stepped cylindrical cavities 52. The opposed cavities 52 are coaxial with each other and are radial to the bore 29. Sleeve seals 14, springs 47, and plugs 46 in these control cavities 52 are, in the illustrated case, identical to those associated with the supply circuit cavities 39.

In the body 11 longitudinally between the stepped cavities 39, 52 are a pair of exhaust ports 53 which exhaust the slide bore 29. The ports 53, which are coaxial with each other, provide communication between the bore 29 and faces 54 of the body 11 at right angles to faces 55 associated with the plugs 46.

The slide 12 is an elongated element formed of stainless steel or other suitable material. The slide 12 is slidably disposed in the bore 29. As viewed in FIG. 1, the left end of the slide 12 has a short, cylindrical extension 57 on which is received a pilot piston 58. The pilot piston 58 abuts a face 59 on the slide 12 extending radially between the extension 57 and the perimeter of a valving portion 61 of the slide. The pilot piston 58 is slidably disposed in the chamber formed by the bore 29 and is sealed therewith by an O-ring. The slide valving portion 61 includes a pair of opposed, flat faces 63 which are parallel to and symmetrically spaced from a longitudinal central axis of the slide 12. To the right of the valving portion 61, the slide 12 has a cylindrical extension 64 which is slidable in the bore 33 and is sealed therewith by an O-ring. To the right of this cylindrical extension 64, the slide 12 has a reduced diameter cylindrical end section 67 and a radial shoulder 68 extending between these cylindrical elements. The extensions 57, 64 and end section 67 are coaxial with the longitudinal central axis of the slide 12. The extension 64 is somewhat smaller in diameter than the pilot piston 58, which, by its assembly with the slide 12, provides an end face for the slide in the pilot chamber area of the bore 29.

A bore or passage 71 is drilled along the extension 57 and valving portion 61 on the central longitudinal axis of the slide 12. The bore 71 is sealed at its outer end by a plug 72. Cylindrical main cross holes 73, 74 extend between the slide faces 63. The cross holes 73, 74 communicate with and are radial to the slide bore 71. The spacing between the cross holes 73, 74 in the longitudinal direction of the slide is equal to the spacing of the cavities 39, 52 in the longitudinal direction of the body 11. In the illustrated case, the cross holes 73, 74 are equal in diameter. Spaced from the leftward main cross hole 73 a limited distance to the right in the longitudinal direction are a pair of shallow holes 76 on the slide faces 63. These holes 76 communicate with the slide bore 29 through associated cross holes 77. Spaced from the other main cross hole 74 this same limited distance is a minor cross hole 78, also between the slide faces 63 and radial to the slide axis. In alternate positions of the slide 12, the left and right sleeve seals 13, 14, register with the cross holes 73, 74, respectively, or with the holes 76 and minor hole 78, respectively.

The end cap 16 is a generally cylindrical, hollow body formed of steel, stainless steel, or other suitable material. On its inner end, the cap 16 is sealed to the bore 34 by an O-ring. A cylindrical axial bore 81 in the cap 16 forms a closed chamber with the body bore 34 and receives the compression springs 17, 18. Adjacent ends of the springs 17, 18 abut an end wall 84 of the cap 16 and opposite adjacent ends of the springs are assembled on a stepped diameter bushing 86. The bushing 86 is fitted on the slide end section 67 and abuts the radial shoulder 68.

Figure 4:
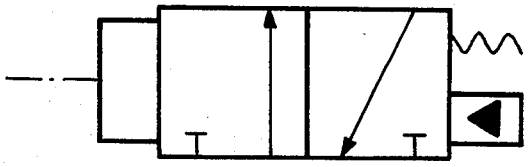
FIG. 4 is a a hydraulic, schematic representation of the valve of FIG. 1.

The valve 10 is represented by the hydraulic schematic circuit in FIG. 4. When pilot pressure of a predetermined level at the pilot port 31 exists, the slide 12 is hydraulically forced to the right, as viewed in FIG. 1, where its shoulder 91 abuts a radial surface 92 at the inner end of the slide bore 29. The pressure of the pilot fluid operates on the leftward face of the pilot piston 58. In this normal operating, open position of the slide 12, the sleeve seals 13, 14 are registered with respective slide ports formed by the cross holes 73, 74 at the slide faces 63 so that the flow paths of both supply sleeves 14 are interconnected to the flow paths of both control sleeves 13 through the slide bore 71. Thus, pressurized fluid at the supply ports 24 is directed by the internal flow paths of the valve to the control ports 26.

When pressure of fluid at the pilot port 31 is reduced below a predetermined level, the slide is driven to the left by the compression forces in the springs 17, 18, and by hydraulic force developed by pressure of fluid at the supply ports 24 acting on the hydraulic area of the slide extension 64. In the full left position, the pilot piston 58 moves to the plane of the end face 23 of the body 11 and the bushing 86 abuts an end wall 93 of the large body bore 34. At this position of the slide 12, the valve is in a closed state, where the supply sleeve seals 14 are interconnected by the minor pressure equalization cross hole 78 and are prevented from communicating with other flow paths in the valve except for the chamber formed by the body and cap bores 34, 81. At the same time, the control sleeve seals 13 register with the slide exhaust ports or holes 76 so that a circuit is completed between each control port 26 and the exhaust ports 53.

Hydraulic sealing forces between the end faces of the sleeve seals 13, 14 and the slide faces 63 are generally proportional to the pressure being sealed at their interfaces. This feature assures the effectiveness of the seals 13, 14 against the slide 12. The disclosed arrangement of the sleeve seals 13, 14 has the advantage that the hydraulic sealing force developed by each seal on the slide 12 is balanced by that of an opposed seal so that there is no net lateral force on the slide.

The seals 13, 14 and their respective slide holes or ports 73, 74 are mutually arranged for non-interflow operation. Inspection of FIG. 1 reveals that the wall thickness of the tubular sleeve seals 13, 14 at the slide faces 63 is at least as large, and preferably slightly larger, in dimension than the diameter of the slide ports 73, 74. Because of this relationship, fluid in the sleeve seals 13, 14 cannot escape or interflow across the faces 63 of the slide 12 into the bore 29 and ultimately to the exhaust ports 53. This non-interflow feature is especially advantageous in certain applications, such as in blow-off preventers in undersea gas and oil wells, where fail-safe operation is imperative. When fluid pressure at the pilot port 31 is reduced, the valve 10 is designed to rely on supply fluid pressure at the ports 24 conducted to the spring receiving bore 34 to assist in shifting the slide 12 leftwardly to the closed position. The energy or delivered power of the supply circuit at the valve 10 may be limited in the blow-off preventer application or similar applications so that it is important that supply fluid not be lost by interflow through the internal valve circuitry.

The disclosed valve is also particularly suited for use in blow-off preventer applications where the pilot line is quite long and operates with a relatively compressible fluid such as a water-based liquid. The pressure of the supply fluid at the ports 24 is effective against the hydraulic area of the slide extension 64, i.e., the cross-sectional slide area at this point. The resultant hydraulic force biases the slide 12, with the additional force of the springs 17, 18, to the closed position and thereby requires relatively high pilot pressure to open the valve or to maintain it open. With a supply pressure of 1500 psi at the ports 24, for example, and the relative diameters of the pilot piston 58 and slide extension 64 and the forces of the springs 17, 18 properly selected, a pilot pressure at the port 31 in the order of 800 to 950 psi can be required to open the valve by overcoming friction and compressing the springs. At these pressures, a major portion of the compressibility of a water-based pilot fluid can be taken up so that a relatively fast response time is achieved. The valve is thus arranged so that a pilot pressure of approximately 70 to 75 percent of supply pressure is required to drive it to the open position. The springs 17, 18 are proportioned to assure that the valve will assume a closed position even in the event of a loss of supply fluid pressure at the ports 24. A suitable force level developed by the springs 17, 18 is one-fourth to one-third of the biasing force developed hydraulically by the supply fluid on the slide extension 64.

The duplex supply and control passages 38, 51 cooperate with the associated pairs of sleeve seals 13, 14 to provide a relatively high flow capacity in the valve. The total supply flow rate is the sum of flows through each supply passage 38 and each associated supply sleeve 14. Similarly, the total control flow rate is the sum of the flows through the sleeve seals 13 and passages 51. In practice, in a non-interflow shear seal design, the size of the flow path through the sleeve seals and slide ports generally governs the overall size of the valve. It is important to keep these elements as small as possible because their size is multiplied several times in the overall dimensions of the sleeve seals, the stroke of the slide, etc.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A directional control valve comprising a housing body having an interior cavity, a valve slide slidably disposed on an axis in the housing cavity, the slide having a pair of opposite generally parallel faces, internal flow passage means in the slide, a port on each slide face in common communication with the internal passage means, said ports having the same axial location on the slide, a pair of sleeve seals carried on the body, each sleeve seal being arranged to cooperate with one of said ports, the wall thickness of each sleeve seal being at least as great as the width of its respective port whereby said sleeve seals provide non-interflow action, a separate passage associated with each sleeve seal for conducting fluid between its associated sleeve seal and an external port on the body, the internal flow passage of the slide extending generally longitudinally within the slide to a zone remote from said slide ports and ported at said zone to the exterior of said slide such that the internal flow passage is arranged to conduct a total flow through both of said sleeve seals whereby a relatively large flow rate is achieved with a relatively small overall physical valve size, said housing including a chamber, said slide having an end face exposed to pressure in said chamber, passage means for connecting said sleeve seals and said chamber through said external port to a common source of fluid pressure external to said housing body, the non-interflow action of the sleeve seals conserving hydraulic energy provided by said source.

2. A directional control valve comprising a housing body having an interior cavity, a valve slide slidably disposed on an axis in the housing cavity, the slide having a pair of opposite generally parallel faces, internal flow passage means in the slide, a port on each slide face in common communication with the internal passage means, said ports having the same axial location on the slide, a pair of sleeve seals carried on the body, each sleeve seal being arranged to cooperate with one of said ports, the wall thickness of each sleeve seal being at least as great as the width of its respective port whereby said sleeve seals provide non-interflow action, a separate passage associated with each sleeve seal for conducting fluid between its associated sleeve seal and an external port on the body, the internal flow passage of the slide extending generally longitudinally within the slide to a zone remote from said slide ports and ported at said zone to the exterior of said slide such that the internal flow passage is arranged to conduct a total flow through both of said sleeve seals whereby a relatively large flow rate is achieved with a relatively small overall physical valve size, a second pair of opposed slide ports and a second pair of sleeve seals, said slide being arranged in one axial position to collect the total fluid flow through the first pair of sleeve seals and slide ports in the internal passage and discharge such collected flow through the second pair of slide ports and sleeve seals, said housing body including a pilot chamber, said slide having an end face exposed to pressure in said pilot chamber and being biased to said one position by such pilot chamber pressure, said housing body including a second chamber, said slide having a second end face exposed to pressure in said second chamber, said second end face having an area less than the area of said first end face, and passage means for connecting said first pair of sleeve seals and said second chamber to a source of fluid pressure external of the housing body and separate from said pilot chamber whereby said separate fluid pressure source requires a relatively high pilot pressure to shift or maintain said slide in said one position.

3. A directional control valve having a housing body, the housing body having a longitudinally extending bore, a valve slide slidably disposed in the bore for movement along the axis of the bore, the slide having a pair of opposed, parallel flat faces symmetrically arranged about the axis, the slide having a pair of parallel cross holes spaced longitudinally along the slide, the cross holes being perpendicular to said slide faces and each forming slide ports on each of said slide faces, the cross holes being interconnected by an internal passage in the slide, the slide ports of each associated pair having the same cross-sectional size, a sleeve seal associated with each slide port and in sealed relationship with a receiving cavity in the body, an end face of each sleeve seal being in abutting sealing contact with a respective one of said slide faces in an open position of said slide, the sleeve seals each being registered with its associated slide port such that it seals on a slide face area bounding the associated slide port, the side wall thickness of each sleeve at its end face having a thickness at least as great as the size of the associated port such that each sleeve provides non-interflow action upon shifting of the valve slide from said open position, a body port for receiving a supply of pressurized fluid, passage means in said body separate from said slide for conducting pressurized fluid from the supply port to one pair of opposed sleeve seal cavities, a body control port for discharging pressurized fluid from the body, passage means in said body separate from said slide for conducting pressurized fluid from the other pair of opposed sleeve seal cavities to the control port, the sleeve seals of each opposed pair and associated slide ports being adapted to conduct substantially the same flow rate when the slide is in the open position, a pilot chamber at one end of the slide for receiving a pilot pressure fluid, said one slide end including a piston area subjected to fluid pressure in the pilot chamber, a chamber at an opposite end of the slide, means for conducting pressurized fluid from the supply port to the opposite chamber, said opposite slide end including an area subjected to fluid pressure in the opposite chamber, the supply pressure in the opposite chamber being effective to require a relatively high pilot pressure in the pilot chamber to maintain the slide in the open position and the non-interflow action of the sleeve seals associated with the one pair of seal cavities conserving hydraulic energy of the supply of pressurized fluid.

4. A valve as set forth in claim 3, including biasing spring means in the opposite chamber to assist said supply pressure in resisting the force of pilot pressure in the pilot chamber on the slide.

5. A valve as set forth in claim 4, wherein said slide is biased to an alternate closed position by supply pressure and said spring means in the opposite chamber, said slide including exhaust hole means registrable with said other pair of sleeve seals once said slide is in said alternate closed position.

6. A valve as set forth in claim 5, wherein said slide includes a pressure equalizing hole interconnecting said one pair of sleeve seals when said slide is in said alternate closed position.

* * * * *